US008256228B2

(12) United States Patent
O'Leary

(10) Patent No.: US 8,256,228 B2
(45) Date of Patent: Sep. 4, 2012

(54) TURBINE BLADE TIP CLEARANCE APPARATUS AND METHOD

(75) Inventor: Mark O'Leary, Zionsville, IN (US)

(73) Assignee: Rolls Royce Corporation, Indianapolis, IN (US)

( * ) Notice: Subject to any disclaimer, the term of this patent is extended or adjusted under 35 U.S.C. 154(b) by 1386 days.

(21) Appl. No.: 12/111,351

(22) Filed: Apr. 29, 2008

(65) Prior Publication Data

US 2009/0266082 A1 Oct. 29, 2009

(51) Int. Cl.
*F02C 6/08* (2006.01)

(52) U.S. Cl. ..... 60/782; 60/806; 415/116

(58) Field of Classification Search ..... 60/782, 60/785, 806; 415/12, 116, 117, 139, 173.2, 415/178

See application file for complete search history.

(56) References Cited

U.S. PATENT DOCUMENTS

| | | | | |
|---|---|---|---|---|
| 3,039,737 | A | 6/1962 | Kolthoff, Jr. | |
| 4,069,662 | A | 1/1978 | Redinger, Jr. et al. | |
| 4,127,357 | A * | 11/1978 | Patterson | 415/116 |
| 4,230,436 | A | 10/1980 | Davison | |
| 4,358,926 | A | 11/1982 | Smith | |
| 4,487,016 | A | 12/1984 | Schwarz et al. | |
| 4,513,567 | A | 4/1985 | Deveau et al. | |
| 4,632,635 | A | 12/1986 | Thoman et al. | |
| 4,657,479 | A | 4/1987 | Brown et al. | |
| 4,683,716 | A | 8/1987 | Wright et al. | |
| 4,815,928 | A | 3/1989 | Pineo et al. | |
| 5,018,942 | A | 5/1991 | Ciokajlo et al. | |
| 5,035,573 | A | 7/1991 | Tseng et al. | |
| 5,048,288 | A | 9/1991 | Bessette et al. | |
| 5,049,033 | A | 9/1991 | Corsmeier et al. | |
| 5,054,997 | A | 10/1991 | Corsmeier et al. | |
| 5,056,988 | A | 10/1991 | Corsmeier et al. | |
| 5,064,343 | A | 11/1991 | Mills | |
| 5,096,375 | A | 3/1992 | Ciokailo | |
| 5,104,287 | A | 4/1992 | Ciokajlo | |
| 5,116,199 | A | 5/1992 | Ciokajlo | |

(Continued)

FOREIGN PATENT DOCUMENTS

DE 4309199 9/1994

(Continued)

OTHER PUBLICATIONS

E. J. Kawecki, Thermal Response Turbine Shroud Study, Jul. 1979, 139 pages, Pratt and Whitney Aircraft Group, West Palm Beach, FL.

*Primary Examiner* — Louis Casaregola
(74) *Attorney, Agent, or Firm* — Krieg DeVault LLP

(57) ABSTRACT

A method for adjusting a clearance between a blade tip of a turbine engine and a blade track spaced radially outward of the blade tip is disclosed herein. The method includes the step of operably coupling an elongate member to a blade track in a turbine engine. The method also includes the step of directing a fluid stream having a temperature in proximity to the elongate member. The temperature of the fluid stream can change over time. The method also includes the step of transferring heat between the fluid stream and elongate member to a change a size of the elongate member and move the blade track radially relative to a centerline axis of the turbine engine. An exemplary apparatus for carrying out the method is also disclosed.

27 Claims, 3 Drawing Sheets

U.S. PATENT DOCUMENTS

| | | | | |
|---|---|---|---|---|
| 5,127,793 | A | 7/1992 | Walker et al. | |
| 5,212,940 | A | 5/1993 | Glover | |
| 5,228,828 | A | 7/1993 | Damlis et al. | |
| 5,261,228 | A | 11/1993 | Shuba | |
| 5,344,284 | A | 9/1994 | Delvaux et al. | |
| 5,407,320 | A | 4/1995 | Hutchinson | |
| 5,553,999 | A | 9/1996 | Proctor et al. | |
| 5,562,408 | A | 10/1996 | Proctor et al. | |
| 5,593,277 | A | 1/1997 | Proctor et al. | |
| 5,601,402 | A | 2/1997 | Wakeman et al. | |
| 5,772,400 | A | 6/1998 | Pellow | |
| 5,791,872 | A * | 8/1998 | Owen | 415/173.2 |
| 5,871,333 | A | 2/1999 | Halsey | |
| 6,035,929 | A | 3/2000 | Friedel et al. | |
| 6,089,821 | A | 7/2000 | Maguire et al. | |
| 6,116,852 | A | 9/2000 | Pierre et al. | |
| 6,393,331 | B1 | 5/2002 | Chetta et al. | |
| 6,487,491 | B1 | 11/2002 | Karpman et al. | |
| 6,652,227 | B2 | 11/2003 | Fried | |
| 6,722,137 | B2 | 4/2004 | Proctor et al. | |
| 6,814,538 | B2 | 11/2004 | Thompson | |
| 6,877,952 | B2 | 4/2005 | Wilson | |
| 6,910,851 | B2 | 6/2005 | Franconi et al. | |
| 6,925,814 | B2 | 8/2005 | Wilson et al. | |
| 6,935,836 | B2 | 8/2005 | Ress, Jr. et al. | |
| 6,942,445 | B2 | 9/2005 | Morris et al. | |
| 7,096,673 | B2 | 8/2006 | Little et al. | |
| 7,210,899 | B2 | 5/2007 | Wilson, Jr | |
| 2001/0023581 | A1 | 9/2001 | Ojiro et al. | |
| 2004/0018084 | A1 | 1/2004 | Halliwell et al. | |
| 2005/0050901 | A1 | 3/2005 | Little | |
| 2005/0109016 | A1 | 5/2005 | Ullyott | |
| 2005/0129499 | A1 | 6/2005 | Morris et al. | |
| 2005/0238480 | A1 | 10/2005 | Phipps et al. | |
| 2007/0003410 | A1 | 1/2007 | Chehab | |
| 2007/0020095 | A1 | 1/2007 | Dierksmeier et al. | |
| 2007/0110564 | A1 | 5/2007 | Leach et al. | |
| 2009/0208321 | A1 * | 8/2009 | O'Leary | 415/14 |

FOREIGN PATENT DOCUMENTS

| | | |
|---|---|---|
| JP | 10196404 | 7/1998 |

* cited by examiner

TURBINE BLADE TIP CLEARANCE APPARATUS AND METHOD

BACKGROUND OF THE INVENTION

1. Field of the Invention

The invention relates generally to gas turbine engines, and more particularly to controlling the radial clearance between a turbine rotor blade tip and a stator shroud assembly.

2. Description of Related Prior Art

In a turbine engine, combustion gases pass across rotatable turbine blades to convert the energy associated with combustion gases into mechanical motion. A shroud assembly tightly encircles the turbine blades to ensure that combustion gases are forced over the turbine blades and do not pass radially around the turbine blades. It is desirable to maintain the smallest possible gap between the tips of the turbine blades and the shroud assembly to maximize the efficiency of the turbine engine. However, a challenge in maintaining the smallest possible gap arises because the turbine blades can expand radially during various phases of engine operation at a rate that is much greater than a rate at which the shroud assembly can radially expand. For example, when the power output of the turbine engine rapidly increases, such as during take-off in a turbine engine used for aircraft propulsion, the turbine blades will increase in radial length rapidly and the tips of the turbine blades may penetrate the inner linings of the shroud assembly. This could damage both the turbine blades and the shroud assembly. Also, this event can compromise the capacity of the shroud assembly to maintain the smallest possible gap during periods of relatively low power production.

SUMMARY OF THE INVENTION

In summary, the invention is a method for adjusting a clearance between a blade tip of a turbine engine and a blade track spaced radially outward of the blade tip is disclosed herein. The method includes the step of operably coupling an elongate member to a blade track in a turbine engine. The method also includes the step of directing a fluid stream having a temperature in proximity to the elongate member. The temperature of the fluid stream can change over time. The method also includes the step of transferring heat between the fluid stream and elongate member to a change a size of the elongate member and move the blade track radially relative to a centerline axis of the turbine engine. An exemplary apparatus for carrying out the method is also disclosed.

BRIEF DESCRIPTION OF THE DRAWINGS

Advantages of the present invention will be readily appreciated as the same becomes better understood by reference to the following detailed description of exemplary embodiments when considered in connection with the accompanying drawings wherein.

DETAILED DESCRIPTION OF EXEMPLARY EMBODIMENTS

Figure 1:
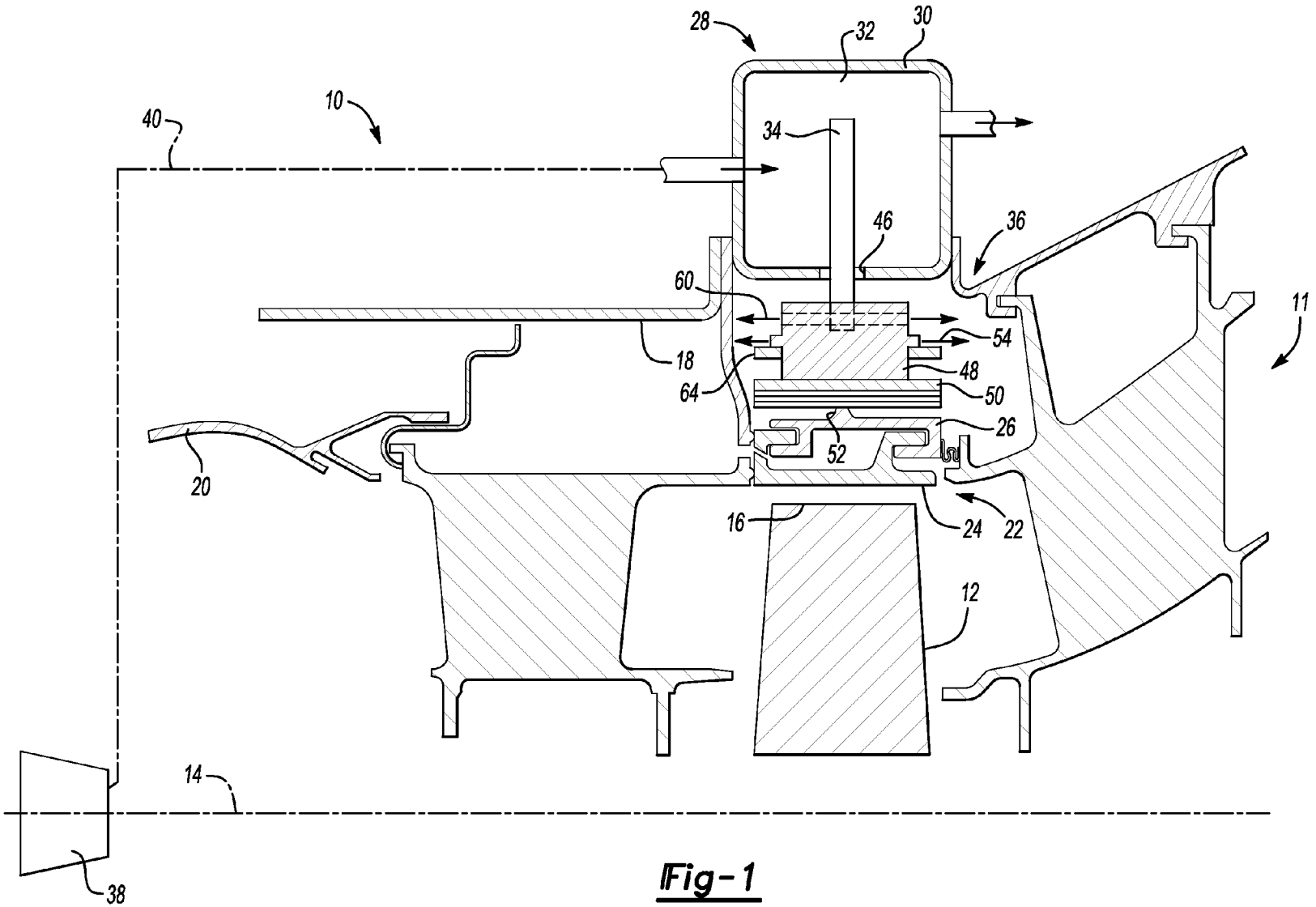
FIG. 1 is a schematic, cross-sectional view of a portion of a turbine engine incorporating a first exemplary embodiment of the invention.

A plurality of different embodiments of the invention are shown in the Figures of the application. Similar features are shown in the various embodiments of the invention. Similar features have been numbered with a common reference numeral and have been differentiated by an alphabetic suffix. Also, to enhance consistency, the structures in any particular drawing share the same alphabetic suffix even if a particular feature is shown in less than all embodiments. Similar features are structured similarly, operate similarly, and/or have the same function unless otherwise indicated by the drawings or this specification. Furthermore, particular features of one embodiment can replace corresponding features in another embodiment or can supplement other embodiments unless otherwise indicated by the drawings or this specification.

The invention provides a method that is at least partially passive for radially moving a blade track relative to a centerline axis in a turbine engine. It may be desirable to practice some embodiments of the invention with some "active system" components such as controllers, sensors and actuators; but the first exemplary embodiment of the invention demonstrates that such components are not required for practicing the invention. Active system components add cost, complexity and bulk to the turbine engine. However, in some situations, the value of a partially-active system outweigh the drawbacks. Several non-exclusive examples of active components that can be included in alternative embodiments of the invention are identified throughout this disclosure.

In the exemplary embodiments of the invention described herein, an elongate member can be heated and cooled by flowing a stream of fluid over the elongate member. Thermal energy can be transferred between the fluid stream and the elongate member, thereby changing the size of the elongate member and the distance between first and second ends of the elongate member. This change in size can be utilized to move a blade track. Thus, the temperature of the stream can change in response to changes in operation, resulting in the elongate member growing and shrinking during the operation of the turbine engine.

"Elongate" refers to the member being relatively thin and relatively long. Making the member thin enhances the of transfer of thermal energy. For example, a thin member has a relatively greater ratio of surface area to mass. As a result, temperature changes can occur throughout the member more quickly. In the exemplary embodiments of the invention, making the member thin results in quicker and more uniform temperature changes in response to changes in the temperature of the fluid stream.

Making the member long enhances the magnitude of size change for a particular change in temperature. For example, the formula for size change is $T \times L \times C$, where T represents the change in the member's temperature, L represents the length of the member at a starting temperature, and C represents the member's coefficient of linear expansion. Thus, the longer the member is originally, the greater the size change in response to a particular temperature change. In the exemplary embodiments of the invention, making the member long results in slight temperature changes producing non-negligible changes in size.

The first exemplary embodiment of the invention is shown in FIGS. 1-4. In FIG. 1, a simplified cross-section of a portion of a turbine engine 10 is shown having a turbine section 11 with at least one turbine blade 12. The turbine blade 12 can be disposed along a centerline axis 14 of the turbine engine 10 and can extend radially away from the centerline axis 14 to a blade tip 16. Structures such as an outer housing member 18 and an interior enclosure 20 can cooperate to direct a flow of combustion gases over the turbine blade 12. A blade track 22 can be positioned radially outward of the turbine blade tip 16. The blade track 22 can ensure that combustion gases are forced over the turbine blade 12, limiting combustion gases from passing radially around the turbine blade tip 16. The exemplary blade track 22 can include an inner portion 24 and an outer portion 26. A gap or clearance can be defined as the radial distance between the inner portion 24 of the blade track 22 and the turbine blade tip 16. The illustrated gap is exaggerated for illustration purposes and not to scale. As will be discussed in greater detail below, the blade track 22 can move radially relative to the centerline axis 14 to accommodate changes in the length of the turbine blade 12. The "length" of the turbine blade 12 can be defined as the radial distance between the turbine blade tip 16 and the centerline axis 14.

The first exemplary embodiment of the invention includes an apparatus or system 28 for carrying out a method for adjusting the clearance or gap between the blade tip 16 the blade track 22. The exemplary apparatus 28 can include a shroud 30 defining a chamber 32. The exemplary chamber 32 is annular, surrounding the centerline axis 14. However, in alternative embodiments of the invention the chamber 32 can be shaped differently.

The chamber 32 can be spaced radially outward of the blade track 22 relative to the centerline axis 14. The exemplary apparatus 28 can also include an elongate member 34 positioned in the chamber 32. The exemplary apparatus 28 can also include a mechanical linkage 36 operably coupling the elongate member 34 to the blade track 22. As will be set forth in greater detail below, the chamber 32 can receive a fluid stream that changes in temperature over time, bathing the elongate member 34 and causing the elongate member 34 to change size. The exemplary mechanical linkage 36 is operable to passively convert a change size of the elongate member 34 into motion of the blade track 22.

As set forth above, the chamber 32 can receive a fluid stream that changes temperature during operation. The temperature of the fluid stream can vary or change so that the elongate member 34 can change size, shrinking or growing. The fluid stream can be received from a compressor section 38 (shown schematically) disposed along the centerline axis 14 of the turbine engine 10. Alternatively, the fluid stream can be drawn from a source other than a compressor section 38 in alternative embodiments of the invention, including structures from hotter areas of the turbine engine 10. The invention can also be practiced such that ambient air is used as the fluid to change a size of the elongate member 34. The invention can also be practiced with two different sources for the fluid stream: a first source for relatively cool fluid and a second, different source for relatively hot fluid. For example, a first stream of "cool" fluid can be drawn from the compressor section 38 to shrink the elongate member 34 and a second stream of "hot" fluid can be drawn from another portion of the turbine engine 10 to grow the elongate member 34.

The invention can also be practiced with one or more heat exchangers for the fluid stream. For example, the fluid stream can be drawn from one or more sources and passed through one or more heat exchangers prior to be received in the chamber 32. Such an embodiment of the invention could also include active elements such as sensors, valves and a controller. A sensor can be positioned upstream of the chamber 32 to sense a temperature of the fluid stream. A controller can communicate with the sensor. If the sensed temperature of the fluid stream is not preferred based on programmed logic, the controller can control a valve in order to divert the fluid stream through a heat exchanger prior to being received in the chamber 32. Alternatively, if the controller determines the temperature sensed by the sensor is appropriate based on programmed logic, the controller can permit the fluid stream to pass directly to the chamber 32.

In the exemplary embodiment of the invention, the fluid stream can be directed to the chamber 32 from the compressor section 38 along a fluid pathway 40 (shown schematically). The fluid stream can be drawn from an outlet of the compressor section 38 or from a bleed at an inter-stage portion of the compressor section 38. In the exemplary embodiment of the invention, the temperature of the fluid stream corresponds to the operating conditions of the turbine engine 10. For example, if the turbine engine 10 is producing power at a relatively high rate, the temperature of a fluid stream drawn from the compressor section 38 can be relatively hot. Alternatively, if the turbine engine 10 is producing power at a relatively low rate, the temperature of a fluid stream drawn from the compressor section 38 can be relatively cool.

The terms "hot" and "cool" are relative; there are no specific temperature ranges or limitations to distinguish between "hot" and "cool". The terms are used to refer to the exchange of thermal energy between the passive elongate member 34 and the fluid stream regardless of the actual temperature of the fluid stream. When the fluid is "hot", for example, thermal energy can be transferred to elongate member 34 from the fluid stream and the elongate member 34 can increase in size. When the fluid is "cool", thermal energy can be transferred from elongate member 34 to the fluid stream and the elongate member 34 can decrease in size. Furthermore, as to the exemplary embodiment of the invention, the range of temperature occurring in a turbine engine during operation can be hundreds of degrees. A particular temperature for the fluid stream can be "cool" at one point during operation of the engine and can be "hot" at a different point during operation.

Figure 2:
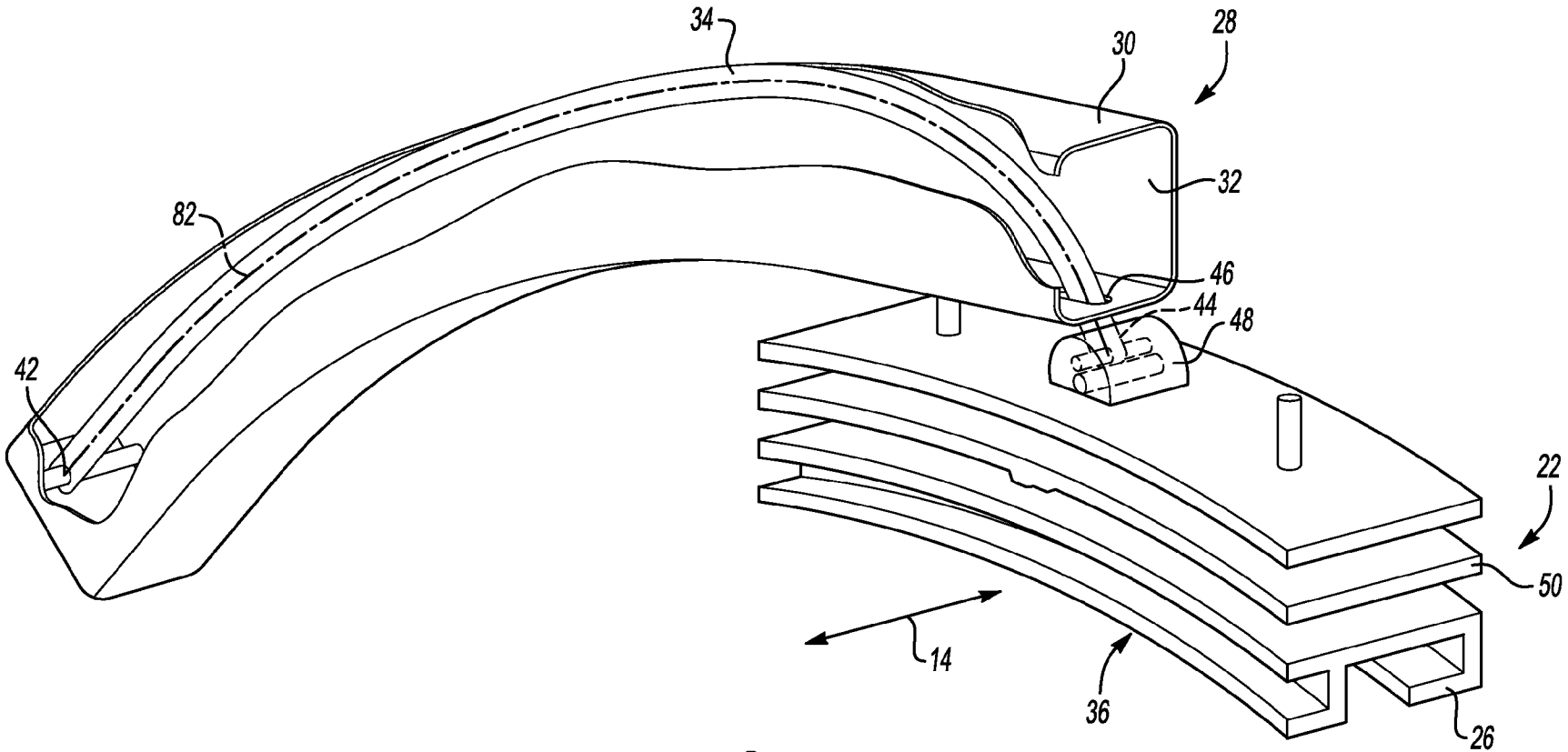
FIG. 2 is a partial perspective view of the first exemplary embodiment of the invention.

Referring now to FIG. 2, the elongate member 34 of the first exemplary embodiment of the invention can extend between first and second ends 42, 44 along a longitudinal axis 82. The exemplary axis 82 is arcuate. The first end 42 can be rectilinearly fixed (capable of pivoting movement) and the second end 44 substantially freely moveable. The exemplary first end 42 of the elongate member 44 can be rectilinear fixed so that a change in the size of the elongate member 34 can be realized in the form of movement of the second end 44. The invention can be practiced in alternative embodiments in which the first end 42 of the passive elongate member 34 is not rectilinearly fixed and size changes in the elongate member 34 are harnessed in some other way.

The exemplary elongate member 34 can be an individual arm extending along the arcuate axis 82. In alternative embodiments of the invention, the elongate member 34 can be straight or be partially straight and partially arcuate. Also, in alternative embodiments of the invention, the elongate member 34 can be a plurality of arms or some other structure operably connected to a single blade track 22. In addition, the Figures of the application show a single apparatus 28 associated with a single blade track 22. However, an alternative embodiment of the invention can include a plurality of apparatus 28, one for each of a plurality of blade tracks 22 in the turbine engine 10. Also, alternative embodiments of the invention can include a single apparatus 28 operably coupled to a plurality of individual blade tracks 22.

The exemplary elongate member 34 can extend transverse or oblique relative to the centerline axis 14, perpendicular or less than perpendicular. In other words, the axis 82 can be defined in a plane that is perpendicular to the centerline axis 14. Extending the elongate member 34 transverse or oblique allows the elongate member 34 to be relatively long while minimizing the envelope size of the apparatus 28 along the centerline axis 14. In other words, the apparatus 28 can be sized smaller by extending the elongate member 34 transverse or oblique to the centerline axis 14 rather than extending the elongate member 14 fully parallel to the centerline axis 14. However, in alternative embodiments of the invention, the elongate member 34 may extend at least in part along the centerline axis 14 or be fully parallel to the centerline axis 14 if desired. In other words, the axis 82 can be defined in a plane that is not perpendicular to the centerline axis 14 and yet is also not the plane in which the centerline axis 14 is defined. Alternatively, the axes 14, 82 can be defined in the same plane in alternative embodiments of the invention.

The exemplary elongate member 34 can extend through a slot 46 in the shroud 30 such that the second end 44 is disposed outside of the chamber 32. The slot 46 allows the second end 44 to move as the elongate member 34 changes size. The distance between the first and second ends 42, 44 changes when the elongate member 34 changes size. The second end 44 is operably coupled to the mechanical linkage 36. The exemplary second end 44 can be limited in movement only in the sense that the second end 44 is operably coupled to the mechanical linkage 36.

Figure 3:
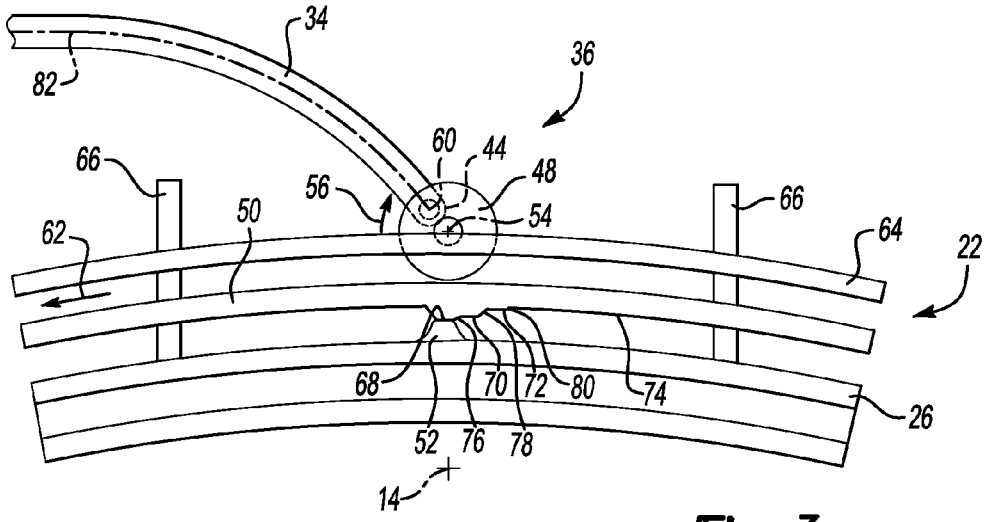
FIG. 3 is a first view of a portion of the turbine engine wherein a mechanical linkage of the first exemplary embodiment is in a first configuration.
Figure 4:
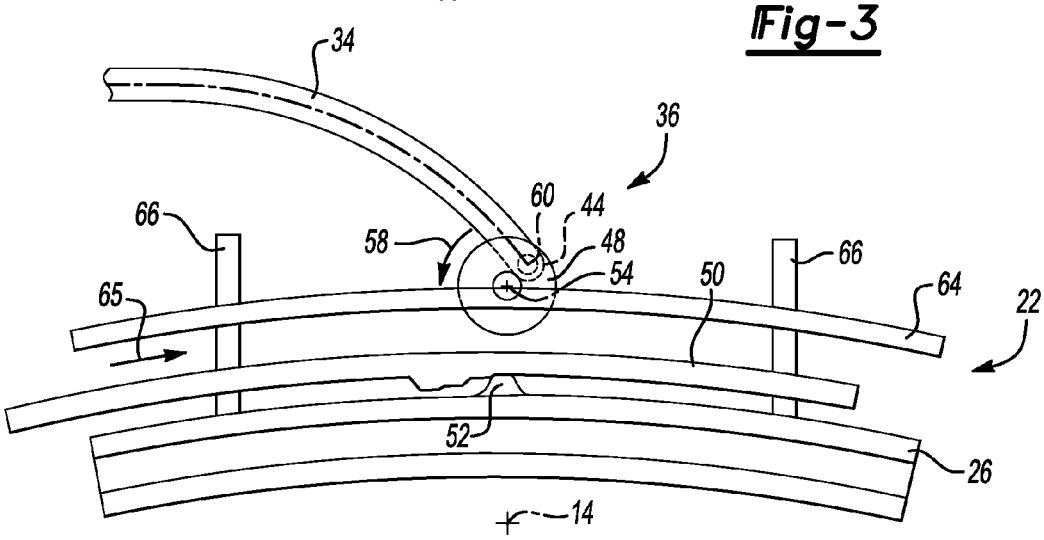
FIG. 4 is a second view of the portion of the mechanical linkage shown in FIG. 3 in a second configuration.

As set forth above, the exemplary mechanical linkage 36 operably couples the second end 44 of the elongate member 34 to the blade track 22 such that a change in size of the elongate member 34, or change in the distance between the first and second ends 42, 44, is passively converted into motion of the blade track 22 away from or towards the centerline axis 14. In the first exemplary embodiment of the invention, the mechanical linkage 36 can include a wheel 48 and a cam member 50. The mechanical linkage 36 can also include a cam follower 52, shown in FIGS. 1, 3 and 4. In operation, a change in the size of the elongate member 34 can pivot the wheel 48. With reference to FIG. 3, when the elongate member 34 grows, the wheel 48 can rotate about an axis 54 in a first direction represented by arrow 56. With reference to FIG. 4, when the elongate member 34 shrinks, the wheel 48 can rotate about the axis 54 in a second direction represented by arrow 58.

With reference to both FIGS. 3 and 4, the second end 44 of the elongate member 34 can be pivotably coupled to the wheel 48. The elongate member 34 and wheel 48 can pivot relative to one another about an axis 60. In response to growth of the elongate member 34, the second end 44 can push against the wheel 48 through the pivot axis 60 to rotate the wheel 48 in the first direction represented by arrow 56 (shown in FIG. 3 only). In response to a decrease in the size of the elongate member 34, the second end 44 of the elongate member 34 can pull the wheel 48 through the pivot axis 60 to rotate the wheel 48 in the second direction represented by arrow 58 (shown in FIG. 4 only).

The wheel 48 can be positioned against the cam member 50 such that rotation of the wheel 48 moves the cam member 50 about the centerline axis 14. The wheel 48 and cam member 50 can include respective and reciprocal gear teeth (not shown) to effectuate movement or can include complementary surfaces that frictionally engage one another. With reference to FIG. 3 only, when the wheel 48 rotates about the axis 54 in the first direction represented by arrow 56, the cam member 50 can rotate about the centerline axis 14 in a third direction represented by arrow 62. With reference to FIG. 4 only, when the wheel 48 rotates about the axis 54 in the second direction represented by arrow 58, the cam member 50 can rotate about the centerline axis 14 in a fourth direction represented by arrow 65.

The cam member 50 can slidably contact the cam follower 52 such that movement of the cam member 50 moves the cam follower 52 radially relative to the centerline axis 14. The cam follower 52 can be fixed to the blade track 22 to move radially together. The exemplary cam follower 52 is integral with the outer portion 26 of the blade track 22. In alternative embodiments of the invention, the cam follower 52 can be separately-formed relative to the blade track 22.

The wheel 48 can be supported for rotating about the axis 54 by a fixed plate 64. The cam member 50 can be guided in pivoting movement about the centerline axis 14 by one or more posts 66. The posts 66 can be received in slots (not shown) in the cam member 50. The cam follower 52 can be supported for radial movement by the posts 66. A biasing member (not shown) can urge the cam follower 52 against the cam member 50.

The exemplary mechanical linkage 36 can be operable to both multiply and dampen movement generated by the change in distance between the first end 42 (shown in FIG. 2) and the second end 44 when imparting movement to the blade track 22. The mechanical linkage 36 can include a movement-multiplier structure to multiply the distance that the second end 44 moves such that the blade track 22 moves radially a first distance greater than the amount of movement of the second end 44. It can be desirable to multiply the movement of the second end 44 so that a relatively small change in the size of the elongate member 34 can result in non-negligible movement of the blade track 22.

The amount or distance that the second end 44 moves can be viewed as the change in the distance between the first end 42 (shown in FIG. 2) and the second end 44 since the first end 42 (shown in FIG. 2) can be rectilinearly fixed. In the first exemplary embodiment of the invention, the cooperation between the second end 44, the wheel 48 and the cam member 50 acts as a movement-multiplier. The wheel 48 and the second end 44 can engage one another at the axis 60. The wheel 48 and the cam member 50 can engage one another at the radius of the wheel 48. The distance between the axes 60, 54 is less than the distance the radius of the wheel 48; therefore, the radius of the wheel 48 moves a greater distance than the distance moved by the axis 60. Thus, a first dimensional value corresponding to the change in size of the elongate member 34 (the change in distance between the first and second ends 42, 44) can multiplied in that a second dimensional value corresponding to the amount of radial movement of the blade track 22 is greater than the first dimensional value. By way of example and not limitation, the distance between the first and second ends 42, 44 can increase by one inch and the distance that the blade track 22 moves radially can be two inches. Again, these values are provided for illustrative purposes; alternative embodiments of the invention can apply any multiplying ratio. It is noted that the wheel 48 need not be round in alternative embodiments of the invention.

The mechanical linkage 36 can include a movement-dampening structure to dampen the movement of the second end 44. In the first exemplary embodiment of the invention, the blade track 22 can be moved intermittently as the distance between the first and second ends 42, 44 changes. It can be desirable to dampen the movement of the second end 44 so that the blade track 22 is not moving continuously. In the first exemplary embodiment of the invention, the cooperation between the cam member 50 and the cam follower 52 acts as a movement-dampener. The exemplary cam member 50 can define a stepped profile surface including alternating landing portions 68, 70, 72, 74 and ramp portions 76, 78, 80 (referenced only in FIG. 3). The cam follower 52 can ride the alternating landing portions 68, 70, 72, 74 and ramp portions 76, 78, 80. Each landing portion 68, 70, 72, 74 can extend over an angle of travel of the cam member 50 about the centerline axis 14. Thus, the cam follower 52 can remain at a particular radial distance from the centerline axis 14 as the cam member 50 moves over the angle defined by one of the landing portions 68, 70, 72, 74.

Figure 5:
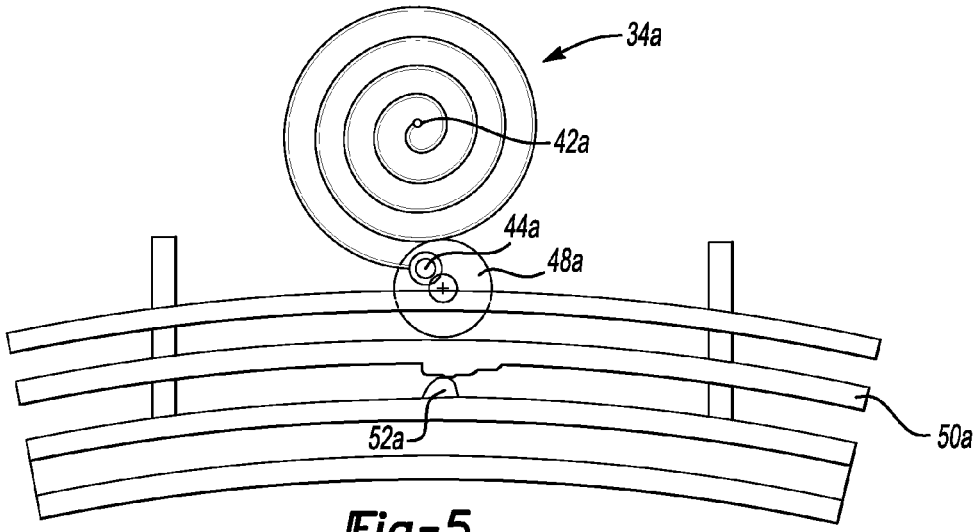
FIG. 5 is a planar view similar to the views in FIGS. 3 and 4, but of a second exemplary embodiment of the invention.

FIG. 5 shows a second alternative embodiment of the invention having an elongate member 34*a*, a wheel 48*a*, a cam member 50*a*, and a cam follower 52*a*. The elongate member 34*a* can take the form of a bimetal, spiral torsion spring extending between a first end 42*a* that is rectilinearly fixed and a second end 44*a* that is rectilinearly movable. As the temperature of the elongate member 34*a* increases, the elongate member 34*a* will "uncoil" and the second end 44*a* will move.

As set forth above, embodiments of the invention, including the exemplary embodiment, can be practiced with active elements. For example, sensors could be positioned at various locations, such as the chamber 32, to sense temperature. The signal output of such sensors can be received, processed, and acted on by a controller to control the operation of one or more valves in order to direct the fluid stream. The operations of such a controller can include the selection of a source for the fluid stream, the flow rate of the fluid stream, and the path taken by the fluid stream prior to reaching the chamber 32.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for adjusting a clearance between a blade tip of a turbine engine and a blade track spaced radially outward of the blade tip, the method comprising the steps of:

operably coupling an elongate member to a blade track in a turbine engine;

directing a fluid stream having a temperature in proximity to the elongate member wherein the temperature can change over time;

transferring heat between the fluid stream and elongate member to a change a size of the elongate member and to move the blade track radially relative to a centerline axis in response to the change in size; and positioning at least a portion of the elongate member in a substantially enclosed chamber; and flowing the fluid stream over the elongate member in the chamber.

2. The method of claim 1 wherein said operably coupling step further comprises the step of:

passively converting a change in the size of the elongate member into radial movement of the blade track.

3. A method for adjusting a clearance between a blade tip of a turbine engine and a blade track spaced radially outward of the blade tip, the method comprising the steps of:

operably coupling an elongate member to a blade track in a turbine engine;

directing a fluid stream having a temperature in proximity to the elongate member wherein the temperature can change over time;

transferring heat between the fluid stream and elongate member to a change a size of the elongate member and to move the blade track radially relative to a centerline axis in response to the change in size; and multiplying a dimensional value of a change in the size of the elongate member with a mechanical linkage such that the blade track moves radially a first distance greater than the dimensional value.

4. The method of claim 1 wherein said operably coupling step includes the step of:

moving the blade track intermittently as the size of the elongate member changes.

5. The method of claim 1 further comprising the step of:

extending the elongate member substantially transverse to the centerline axis.

6. The method of claim 1 wherein said directing step is further defined as:

directing fluid from an outlet of a compressor section to contact the elongate member.

7. A method for adjusting a clearance between a blade tip of a turbine engine and a blade track spaced radially outward of the blade tip, the method comprising the steps of:

operably coupling an elongate member to a blade track in a turbine engine;

directing a fluid stream having a temperature in proximity to the elongate member wherein the temperature can change over time;

transferring heat between the fluid stream and elongate member to a change a size of the elongate member and to move the blade track radially relative to a centerline axis in response to the change in size; and connecting one end of the elongate member with a wheel such that the wheel rotates in response to a change in the size of the elongate member;

positioning the wheel against a cam member such that the cam member moves about the centerline axis in response to rotation of the wheel;

contacting the cam member against a cam follower such that the cam follower moves radially in response to movement of the cam member; and fixing the cam follower and the at least one blade track to move radially together.

8. An apparatus for adjusting a clearance between a blade tip of a turbine engine and a blade track spaced radially outward of the blade tip, the apparatus comprising:

at least one blade track operable to move radially relative to a centerline axis of a turbine engine;

an elongate member having one end operably coupled to said at least one blade track; and a fluid pathway operable to direct a fluid stream having a temperature in proximity to the elongate member wherein the temperature can change over time; and a chamber for receiving the fluid stream and at least partially enclosing said elongate member, wherein at least one end of said elongate member is disposed outside of said chamber.

9. The apparatus of claim 8 wherein said elongate member is an individual arm being straight or arcuate.

10. The apparatus of claim 8 wherein the elongate member extends between a first end and a second end operably coupled to said at least one blade track and wherein said first end is rectilinearly fixed and said second end is substantially freely moveable.

11. An apparatus for adjusting a clearance between a blade tip of a turbine engine and a blade track spaced radially outward of the blade tip, the apparatus comprising:

at least one blade track operable to move radially relative to a centerline axis of a turbine engine;

an elongate member having one end operably coupled to said at least one blade track; and a fluid pathway operable to direct a fluid stream having a temperature in proximity to the elongate member wherein the temperature can change over time; and a multiplying member operable to convert a dimensional value of a change in the size of the elongate member into a first amount of movement for moving said at least one blade track, the first amount of movement being greater than the dimensional value.

12. The apparatus of claim 11 wherein said multiplying member comprises:

a wheel operable to rotate about a wheel axis and operably coupled to a first end of said elongate member a first distance from said wheel axis, said wheel including an engaging surface operable to transmit said first amount of movement, said engaging surface spaced a second distance from said wheel axis greater than said first distance.

13. The apparatus of claim 11 wherein said mechanical linkage further comprises:

a dampening member operably engaged with said multiplying member such that said multiplying member imparts said first amount of movement to said dampening member and said dampening member intermittently transmits a second amount of movement to said at least one blade track in response to said first amount of movement.

14. The apparatus of claim 13 wherein said dampening member comprises:

a cam member having a stepped profile surface with alternating landing portions and ramp portions.

15. A turbine engine comprising:

a compressor section disposed along a centerline axis;

a turbine section spaced from said compressor section along said centerline axis and having at least one turbine blade extending radially to a blade tip;

a blade track positioned radially outward of said blade tip;

a chamber spaced radially outward of said blade track relative to said centerline axis;

a fluid pathway communicating a fluid stream from said compressor section to said chamber;

an elongate member positioned in said chamber and having a first end rectilinearly fixed in said chamber and second end substantially freely moveable; and a mechanical linkage operably coupling said second end of said elongate member to said blade track and operable to passively convert a change in the distance between the first and second ends into radial motion of said blade track relative to said centerline axis.

16. The turbine engine of claim 15 wherein said mechanical linkage further comprises:

a cam member moveable about said centerline axis; and a cam follower fixed to said blade track and operably coupled to said cam member such that said cam follower moves radially relative to said centerline axis in response to movement of said cam member about said centerline axis.

17. The turbine engine of claim 15 wherein said mechanical linkage is further defined as being operable to both multiply and dampen movement generated by the change in distance between said first and second ends when imparting movement to said blade track.

18. The method of claim 3 wherein said operably coupling step further comprises the step of:

passively converting a change in the size of the elongate member into radial movement of the blade track.

19. The method of claim 3 wherein said operably coupling step includes the step of:

moving the blade track intermittently as the size of the elongate member changes.

20. The method of claim 3 further comprising the step of:

extending the elongate member substantially transverse to the centerline axis.

21. The method of claim 3 wherein said directing step is further defined as:

directing fluid from an outlet of a compressor section to contact the elongate member.

22. The method of claim 7 wherein said operably coupling step further comprises the step of:

passively converting a change in the size of the elongate member into radial movement of the blade track.

23. The method of claim 7 wherein said operably coupling step includes the step of:

moving the blade track intermittently as the size of the elongate member changes.

24. The method of claim 7 further comprising the step of:

extending the elongate member substantially transverse to the centerline axis.

25. The method of claim 7 wherein said directing step is further defined as:

directing fluid from an outlet of a compressor section to contact the elongate member.

26. The apparatus of claim 11 wherein the elongate member extends between a first end and a second end operably coupled to said at least one blade track and wherein said first end is rectilinearly fixed and said second end is substantially freely moveable.

27. The apparatus of claim 11 wherein said elongate member is an individual arm being straight or arcuate.

* * * * *